US010413805B2

(12) United States Patent
James et al.

(10) Patent No.: US 10,413,805 B2
(45) Date of Patent: Sep. 17, 2019

(54) SLIP PREVENTION APPARATUS AND METHOD FOR SNOW EQUIPMENT

(71) Applicant: Tosbl, LLC, Tulsa, OK (US)

(72) Inventors: Jeffrey Roberts James, Tulsa, OK (US); Christopher Todd Zenthoefer, Tulsa, OK (US)

(73) Assignee: TOSBL, LLC, Tulsa, OK (US)

( * ) Notice: Subject to any disclaimer, the term of this patent is extended or adjusted under 35 U.S.C. 154(b) by 0 days.

(21) Appl. No.: 15/729,547

(22) Filed: Oct. 10, 2017

(65) Prior Publication Data

US 2019/0105552 A1 Apr. 11, 2019

(51) Int. Cl.
*A63C 11/26* (2006.01)

(52) U.S. Cl.
CPC ..... *A63C 11/26* (2013.01)

(58) Field of Classification Search
CPC ..... A63C 11/00; A63C 10/08; A63C 10/12; A63C 10/145; A63C 10/26
See application file for complete search history.

(56) References Cited

U.S. PATENT DOCUMENTS

| | | | |
|---|---|---|---|
| 4,142,752 | A | 3/1979 | Chilton |
| 5,217,269 | A | 6/1993 | Wiltberger |
| 5,509,616 | A | 4/1996 | Millen, Jr. et al. |
| 5,535,960 | A | 7/1996 | Skowronski et al. |
| 5,598,727 | A | 2/1997 | White |
| 5,833,165 | A | 11/1998 | Paugh |
| 5,954,288 | A | 9/1999 | Shih |
| 6,003,911 | A | 12/1999 | Sowash |
| 6,199,784 | B1 | 3/2001 | Wang et al. |
| 6,199,785 | B1 | 3/2001 | Paugh |
| 6,220,631 | B1 | 4/2001 | Pritchard |
| 6,290,158 | B1 | 9/2001 | Huang |
| 6,293,485 | B1 | 9/2001 | Hollowed |
| 6,325,665 | B1 | 12/2001 | Chung |
| 6,364,237 | B1 | 4/2002 | Kagel |
| 6,439,490 | B1 | 8/2002 | Hwang |
| 6,547,746 | B1 | 4/2003 | Marino |
| 6,616,080 | B1 | 9/2003 | Edwards et al. |
| 6,616,128 | B2 | 9/2003 | Selzer |
| 6,694,922 | B2 | 2/2004 | Walter et al. |
| 6,702,328 | B2 | 3/2004 | Malleis |

(Continued)

*Primary Examiner* — James A Shriver, II
*Assistant Examiner* — James J Triggs
(74) *Attorney, Agent, or Firm* — VOZ Patents, LLC

(57) ABSTRACT

Certain embodiments of the invention provide a slip prevention apparatus for snowboard and ski equipment. In certain embodiments, the slip prevention apparatus lifts the ski or snowboard off the ground or snow to temporarily immobilize the ski or snowboard. In certain embodiments, the slip prevention apparatus creates a point of traction, while providing a stable platform to stand while strapping into bindings. Certain embodiments include a stop element that provides a point of traction. Certain embodiments of the invention include a retractable tether. Certain embodiments of the invention provide various types of stop elements. Certain embodiments of the invention include a cord having a magnet on an end, and a corresponding magnet attached to a stop element. In certain embodiments, when the user has finished strapping in, the retractable tether returns a stop element to a secure position.

18 Claims, 3 Drawing Sheets

(56) References Cited

U.S. PATENT DOCUMENTS

| | | | | |
|---|---|---|---|---|
| 6,929,209 | B2 | 8/2005 | Baumgarten | |
| 7,007,882 | B2 | 3/2006 | Raia et al. | |
| 7,374,123 | B2 | 5/2008 | Han | |
| 7,661,620 | B2 | 2/2010 | Fields | |
| 7,665,684 | B2 | 2/2010 | Salentine et al. | |
| 7,755,483 | B2 | 7/2010 | Schmidt | |
| 7,762,215 | B2 | 7/2010 | Horton | |
| 8,402,925 | B2 | 3/2013 | Le Croix | |
| 8,534,587 | B2 | 9/2013 | He | |
| 8,556,295 | B2 * | 10/2013 | Johnson | A63C 7/1066 280/809 |
| 8,746,519 | B2 | 6/2014 | Young et al. | |
| 8,757,532 | B2 | 6/2014 | Votel et al. | |
| 9,205,321 | B2 | 12/2015 | Geiger | |
| 9,545,561 | B2 | 1/2017 | Edmonston | |
| 9,718,640 | B2 | 8/2017 | Burner et al. | |
| 2002/0024212 | A1 | 2/2002 | Malleis et al. | |
| 2004/0032741 | A1 | 2/2004 | Tai | |
| 2004/0036257 | A1 | 2/2004 | Lille et al. | |
| 2007/0278265 | A1 | 12/2007 | Contents | |
| 2008/0035778 | A1 | 2/2008 | Belden et al. | |
| 2008/0042000 | A1 | 2/2008 | Horton | |
| 2008/0265082 | A1 | 10/2008 | Angiuli | |
| 2008/0283651 | A1 | 11/2008 | Ito et al. | |
| 2011/0254293 | A1 | 10/2011 | Duff et al. | |
| 2013/0008392 | A1 | 1/2013 | Holmstrom | |
| 2013/0059704 | A1 * | 3/2013 | McCants | A63B 69/0059 482/131 |
| 2013/0277926 | A1 | 10/2013 | Rains | |
| 2013/0318882 | A1 | 12/2013 | Booker et al. | |
| 2014/0000322 | A1 | 1/2014 | Williams | |
| 2015/0157923 | A1 | 6/2015 | Nejad | |
| 2015/0223588 | A1 | 8/2015 | DeNittis et al. | |
| 2016/0051886 | A1 | 2/2016 | Edmonston | |
| 2017/0022025 | A1 | 1/2017 | Burner et al. | |

* cited by examiner

SLIP PREVENTION APPARATUS AND METHOD FOR SNOW EQUIPMENT

FIELD OF THE INVENTION

Embodiments of the present invention generally relate to an apparatus for assisting users of snow-related equipment including skis and snowboards.

BACKGROUND OF THE INVENTION

Snowboarding and skiing are two common recreational snow activities. Since its inception in the 1960s and 1970s, snowboarding has gained mainstream popularity as a snow sport. Typical snowboards require the snowboarder to attach both feet to snowboard bindings. When both feet are not attached to the snowboard binding, a user may attach one foot (usually the front foot) to the snowboard while the other foot (usually the rear foot) remains free. In this manner, a user may more effectively ride a chair lift, exit a chair lift, or traverse flat or uphill grades.

While skiing does not require removing the boots from the bindings, snowboarders must remove at least one of the boots from the bindings when not riding down the hill. In order to attach the free foot or both feet to the snowboard bindings (also commonly known as "strapping in"), users typically perform several steps. Users typically sit down on the snow, lean forward, secure their boot or boots to the bindings, and then stand up while balancing themselves. It is often cumbersome to secure the snowboard while sitting down. Sitting down can also be uncomfortable depending on a snowboarder's body type. There is a risk for his or her backside to get wet from the snow. These extra steps also involve extra effort and time.

Snowboarders must strap in after riding the chair lift. Oftentimes, the area surrounding the top of a chair lift can become busy and dangerous while snowboarders strap in. A crowd that forms at the top of the chair lift can cause crowd congestion, leading to potential falls and injuries as snowboarders and skiers exit the chair lift. The act of sitting down to strap in generally takes a longer amount of time than standing up to strap in. This act of sitting down can contribute to the congestion. Sitting down also reduces one's range of motion, especially while wearing heavy and/or bulky snow gear and goggles, making it difficult for snowboarders to react quickly enough to avoid other incoming skiers and snowboarders. Therefore, there is a general need for a slip prevention apparatus to allow a snowboarder to strap in while solving some of these aforementioned problems.

Certain items that assist a user to strap in include U.S. Pat. No. 6,702,328 to Malleis et al. ("the '328 Patent") entitled "*Snowboard Accessory and Method for Engaging Boot with Binding*" and incorporated herein by reference, and U.S. Patent Publication No. 2002/0024212 to Malleis et al. ("the '212 Patent Publication") entitled "*Snowboard Accessory and Method for Engaging Boot with Binding*" and incorporated herein by reference. The '328 Patent and '212 Patent Publication describe a tether, where a first portion of the tether is intended to be gripped by the user, and a second portion is anchored to a snowboard. However, the tether anchor requires modification to existing equipment. This modification can lead to additional installation costs, additional time, and additional effort. In some cases, the modification described in the '328 Patent and '212 Patent Publication can affect the rideability of the snowboard, as the modification requires drilling through the bottom surface of the board. Furthermore, in order to prevent snagging, a user is required to bend down and physically attach and detach the tether from the snowboard. These steps can also lead to more effort, particularly when wearing thick gloves, as a user may be required to remove the gloves before attaching the tether to the snowboard, or assembling the tether.

Certain other items that assist a user to strap in include U.S. Patent Publication No. 2016/0051886 to Edmonston ("the '886 Patent Publication") entitled "*Snowboard Support Devices and Methods*" and incorporated herein by reference, and U.S. Pat. No. 9,545,561 to Edmonston ("the '561 Patent") entitled "*Snowboard Support Devices and Methods*" and incorporated herein by reference. The '886 Patent Publication and '561 Patent describe a snowboard-mounted stopper that is affixed to a snowboard. Deploying the stopper below a lower surface of the snowboard allows the user to stand up while strapping in. However, the disclosures in the '886 Patent Publication and '561 Patent requires modification to existing equipment. This modification can lead to additional installation costs, additional time, and additional effort. Inadvertent deployment of the stopper in the '886 Patent Publication and '561 Patent, especially while riding the snowboard, can cause damage to the snowboard and/or injury to the user, or affect nearby skiers and snowboarders. Skiers and snowboarders also experience backcountry terrain, where riders avoid certain obstacles including trees, rocks, and ice. Because the snowboard-mounted stopper in the '886 Patent Publication and '561 Patent is located on a surface of a snowboard, there is a possibility for certain obstacles to snag on the snowboard-mounted stopper, leading to potential injury and damage to equipment.

Therefore, there is a need for a slip prevention apparatus that allows a snowboarder to strap in while standing, as to solve a number of the aforementioned problems. There is a need for a slip prevention apparatus to allow a snowboarder to stand while strapping in, as to reduce re-strapping process, to reduce unnecessary movements while strapping in, and to strap in more comfortably. There is also a need for a slip prevention apparatus to allow a snowboarder to stand tall while strapping in, as to provide the snowboarder with situational awareness and to avoid potential accidents and collisions from incoming snowboarders and skiers while strapping in. There is a need for a slip prevention apparatus that includes the advantages of preserving the integrity of existing equipment, avoiding damage to equipment and avoiding injury to a user through the use of the slip prevention apparatus. There is also a need for a slip prevention apparatus that can be tucked away or safely stored when not in use. There is also a need for a slip prevention apparatus that has the benefit of being free from snagging when in use and when not in use.

SUMMARY OF THE INVENTION

It is the object of certain embodiments to provide a slip prevention apparatus that allows users of snow-related equipment, including skis and snowboards, to secure the equipment to the user's boots in a quicker and safe manner. It is also the object of certain embodiments to allow a user to strap in while standing. It is also the object of certain embodiments to allow a user to speed up the re-strapping process, reduce unnecessary movements, and reduce the amount of time and energy needed to strap in. It is also the object of certain embodiments to allow a user to keep their backside dry, and provide the user with situational awareness.

In certain embodiments, a user simply places the slip prevention apparatus between the board and the ground. In certain embodiments, the slip prevention apparatus lifts the ski or snowboard off the ground or snow to temporarily immobilize the ski or snowboard. The slip prevention apparatus creates a point of traction, while providing a stable platform to stand while strapping into the bindings. Certain embodiments include a stop element that provides a point of traction. Certain embodiments of the invention include a retractable tether. In certain embodiments, when the user has finished strapping in, the retractable tether returns a stop element to a secure position.

Certain embodiments of the invention provide various types of stop elements. Depending on the temperature, weather, and characteristic of the snow or snow condition (e.g. ice, heavy powder, slush, groomed), certain stop elements would be more advantageous than others. Certain embodiments of the invention include a cord having a magnet on an end, and a corresponding magnet attached to a stop element. The magnetic attachment of a cord to a stop element allows a user to exchange the stop element fit for a given snow condition. The magnetic attachment also provides a safety release, for example, if a stop element becomes caught in an object (e.g. tree, ski lift) while skiing or snowboarding. Certain embodiments include a stop element that slides over an edge of a ski or snowboard, as to prevent it from being buried in snow.

In certain embodiments, a strap secures the slip prevention apparatus to an attachment point on a user, for example, a user's leg, calf, boot, waist, or on a ski or snowboard. In certain embodiments, a release feature allows releasable attachment of the strap. In certain embodiments, a release feature includes, but is not limited to, for example, a buckle, hook and loop attachment, a carabiner, a hook, a clip and magnets. After a user straps into the bindings, hopping or lifting frees the stop element from underneath the ski or snowboard. In certain embodiments, the retractable tether retracts the cord and the stop element, and returns the stop element to the proximity of the strap, which helps to store the stop element away from the ski or snowboard. Retracting the stop element away from the ski or snowboard is advantageous, as it prevents accidental deployment.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION

Figure 1:
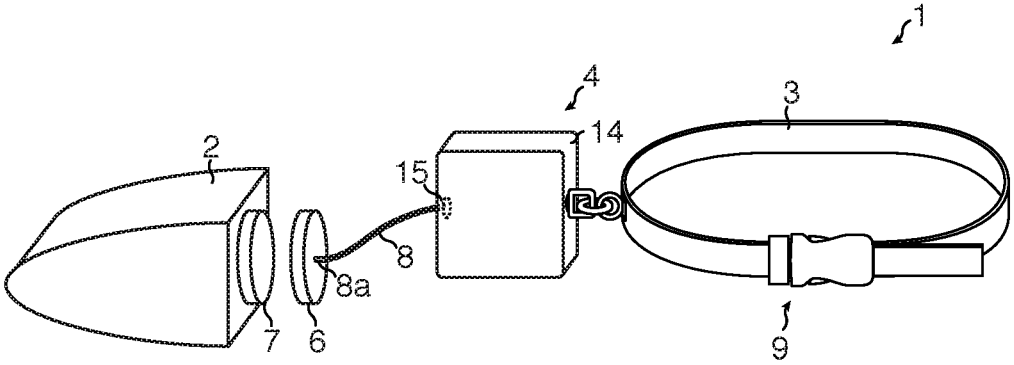
FIG. 1: An embodiment of a slip prevention apparatus in certain embodiments.

In certain embodiments of the invention, a slip prevention apparatus is provided for assisting users to strap into their ski equipment. Referring to FIG. 1, in certain embodiments, a slip prevention apparatus 1 includes a stop element 2, a cord 8, a retractable tether 4, and a strap 3. A strap is attachable to any number of locations, including but not limited to, for example, a user's leg, calf, boot, belt, waist, or on a ski or snowboard. Still referring to FIG. 1, in certain embodiments, a strap includes a first release feature 9, for example, a buckle, for attachment. It will be appreciated that a strap is attached to user or ski or snowboard with other types of releasable elements, including but now limited to hook and loop attachment, carabiners, hooks, clips, and magnets.

Still referring to FIG. 1, in certain embodiments, a slip prevention apparatus 1 includes a retractable tether 4 with a housing 14 attached to a strap 3. The retractable tether has a cord 8. It will be appreciated that a retractable tether typically has a housing 14 that houses a spiral torsion spring, a cord, and a spool. In certain embodiments, one end of a cord is attached to the spool, and the cord is further wrapped around the spool. A cord end 8*a* exits the housing 14 through an opening 15. The spiral torsion spring generally has a first end attached to the housing, and a second end attached to the spool. Pulling a cord out of the retractable tether rotates the spool about an axis and loads the spiral torsion spring, storing energy in the form of a recoil force. Release of the cord returns the cord into the retractable tether. It will be appreciated that a number of retractable tethers can be used for the purposes described herein.

Still referring to FIG. 1, in certain embodiments, a cord end 8*a* is attached to a first magnet 6. A stop element 2 includes a second magnet 7 mateable with a first magnet 6. It will be appreciated that a magnet 6, 7 includes, but is not limited to, for example, ferrite magnets, aluminum nickel cobalt magnets, neodymium iron boron magnets, and samarium cobalt magnets. In certain embodiments, one of the magnets 6 or 7 is ferromagnetic or ferrimagnetic, while the other magnet 6 or 7 is magnetically attractable.

Figure 2A:
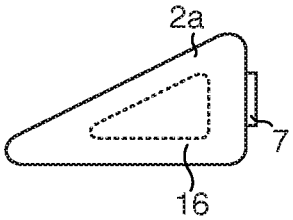
FIG. 2A: An embodiment of a stop element in certain embodiments.

As seen in FIG. 2A-2E, in certain embodiments, a stop element is placed underneath a ski or snowboard. Referring to FIG. 2A, a stop element includes a wedge 2*a*, referring to FIG. 2B, a stop element includes a plate 2*b*, referring to FIG. 2C, a stop element includes a clamp 2*c*, referring to FIG. 2D, a stop element includes an orb 2*d*, and referring to FIG. 2E, a stop element includes a polyhedron 2*e*. Still referring to FIG. 2A-2E, embodiments of a stop element 2*a*-2*e*, include a second magnet 7. It will be appreciated that certain embodiments of a stop element have other shapes, including, but not limited to cylinders, cones, cubes, torus, and cuboids. In certain embodiments, a stop element includes a cavity 16

Figure 2B:
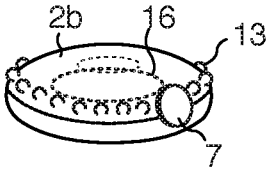
FIG. 2B: An embodiment of a stop element in certain embodiments.
Figure 2C:
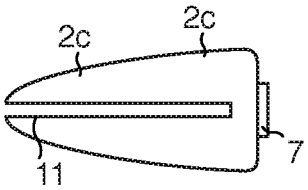
FIG. 2C: An embodiment of a stop element in certain embodiments.
Figure 2D:
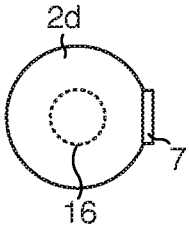
FIG. 2D: An embodiment of a stop element in certain embodiments.
Figure 2E:
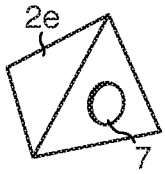
FIG. 2E: An embodiment of a stop element in certain embodiments.

(for example, as shown in FIG. 2A, FIG. 2B, and FIG. 2D). A cavity 16 is filled with air, liquid, and/or other materials. In certain embodiments, the stop element cavity is connected to the exterior with a tube, allowing the stop element to be inflated and deflated by a user.

The stop element generally lifts the ski or snowboard off the surface of the snow to provide traction, allowing a user to balance and strap in. It will be appreciated that in certain embodiments, a stop element having other shapes provide traction to a ski or snowboard. In certain embodiments, a stop element includes a material providing traction. Examples of materials include, but are not limited to materials polymeric such as rubbers natural and synthetic, rubber compounds, rubber composite materials, polysiloxanes, polyurethane, polybutadiene, polyethylene terephthalate (PET), polyvinyl chloride (PVC), and plant-based materials such as cork. In certain embodiments, a stop element includes a non-abrasive material. In certain embodiments, as seen in FIG. 2B, a stop element further includes surface features 13 such as nubs to increase traction.

Figure 3A:
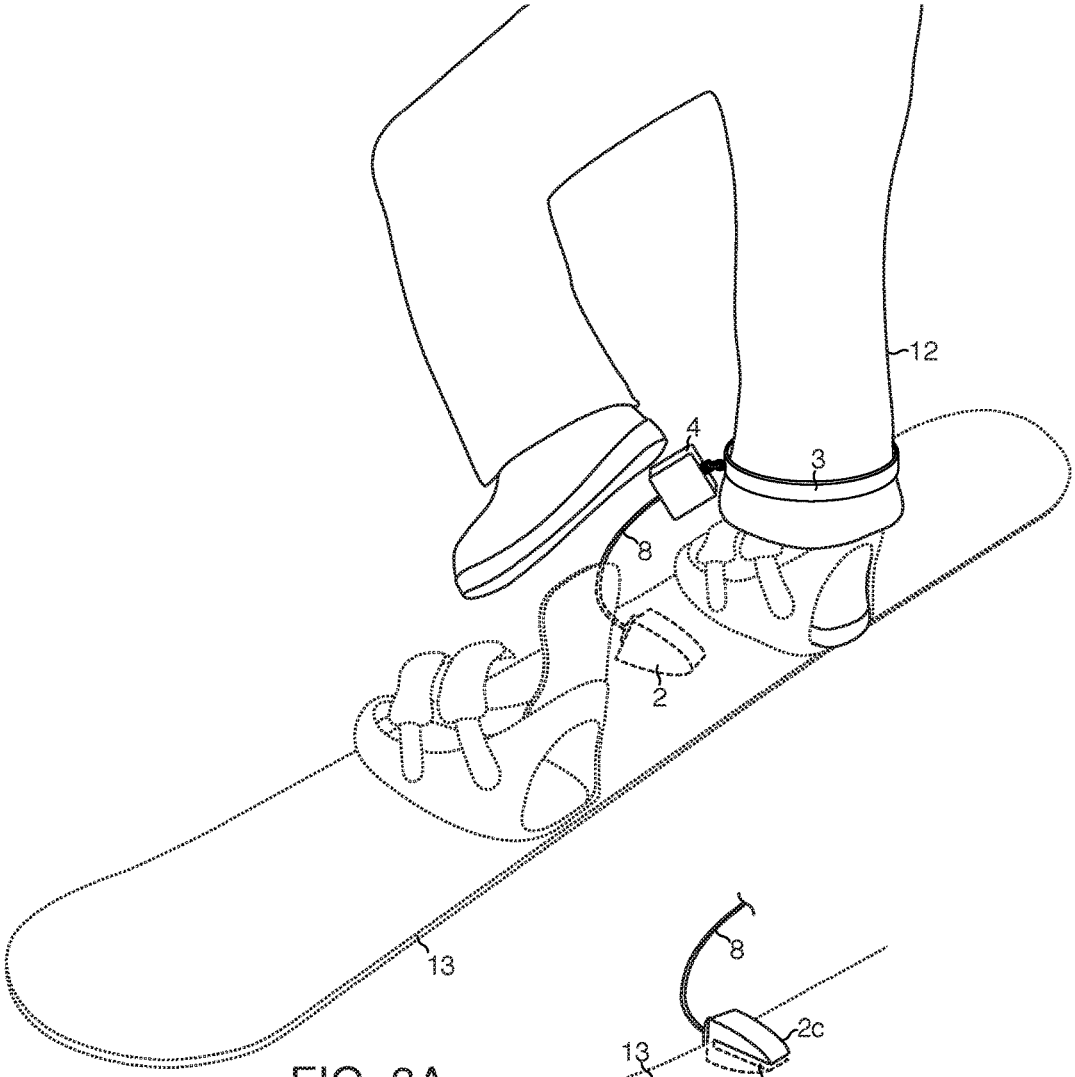
FIG. 3A: An embodiment of a slip prevention apparatus attached to a user in certain embodiments

Referring to FIG. 3A, a user attaches a slip prevention apparatus 1 to, for example, the leg 12, ankle, calf, waist, and other body parts. It will be appreciated that a slip prevention apparatus 1 is also attached to other parts, including a user's boot, snowboard, and the like. As seen in FIG. 3A, the strap 3 is secured to a user's leg 12. The strap is connected to a retractable tether 4 having an extensible cord 8, and a stop element 2 magnetically attached to the cord 8. Placement of the stop element 2 under a snowboard 13 allows a user to strap in while standing.

Figure 3B:
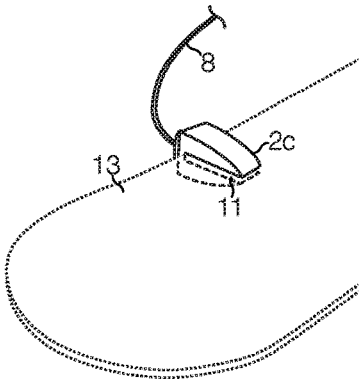
FIG. 3B: An embodiment of a stop element attached to a snowboard in certain embodiments

Referring to FIG. 2C, an embodiment of a clamp 2*c* has a slit 11 dividing an upper portion 15*a* and lower portion 15*b*. As seen in FIG. 3B, a user places an edge of a snowboard 13 through slit 11. It will be appreciated that a clamp 2*c* design is advantageous in preventing the stop element from being buried in certain snow conditions, for example, in powdery snow.

Figure 4:
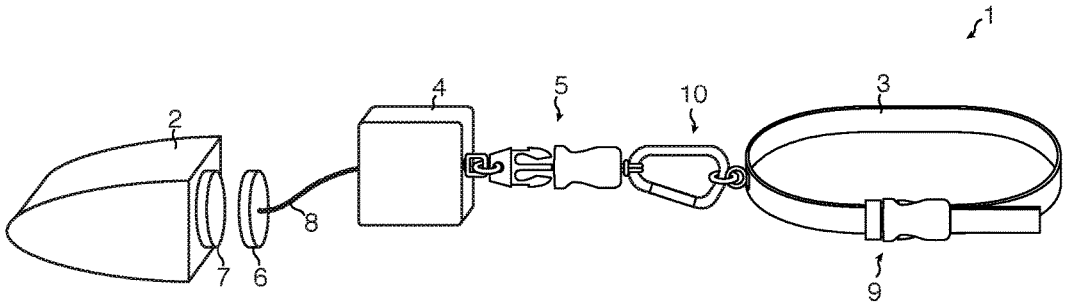
FIG. 4: An embodiment of a slip prevention apparatus in certain embodiments.

As seen in FIG. 4, an embodiment of a slip prevention apparatus 1 includes a release feature to facilitate easy attachment and removal. In certain embodiments, a second release feature 5, such as a buckle provides attachment and detachment between a retractable tether 4 and a strap 3. In certain embodiments, a third release feature 10, such as a carabiner, provides easy attachment and removal of a retractable tether 4 from a strap 3. In certain embodiments, a third release feature 10, such as a carabiner allows attachment to a user, including, for example, on a user's belt loop or belt.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A slip prevention apparatus comprising:
a strap;
a stop element comprising a clamp having an upper portion, a lower portion, and a slit therebetween;
a retractable tether;
the strap further comprising a first release feature;
the retractable tether further comprising a housing and a cord, the cord having an end attached to a first magnet, and the housing attached to the strap; and
the stop element attached to a second magnet, wherein the second magnet is configured to attach to the first magnet.

2. The slip prevention apparatus of claim 1, wherein the stop element comprises rubber.

3. The slip prevention apparatus of claim 1, wherein the stop element comprises a wedge.

4. The slip prevention apparatus of claim 1, wherein the stop element comprises a plate.

5. The slip prevention apparatus of claim 4, wherein the plate further comprises a surface feature.

6. The slip prevention apparatus of claim 1, wherein the stop element comprises an orb.

7. The slip prevention apparatus of claim 1, wherein the stop element comprises a polyhedron.

8. The slip prevention apparatus of claim 1, the first release feature is a buckle.

9. The slip prevention apparatus of claim 1, wherein the retractable tether is attached to the strap with a second release feature.

10. The slip prevention apparatus of claim 9, wherein the second release feature is a buckle.

11. A slip prevention apparatus comprising:
a strap;
a stop element comprising a clamp;
a retractable tether;
the retractable tether further comprising a housing and a cord, the cord having an end attached to a first magnet, the housing attached to a release feature, the strap attached to the release feature; and
the stop element attached to a second magnet, wherein the second magnet is configured to attach to the first magnet.

12. The slip prevention apparatus of claim 11, wherein the stop element comprises rubber.

13. The slip prevention apparatus of claim 11, wherein the stop element comprises a wedge.

14. The slip prevention apparatus of claim 11, wherein the stop element comprises a plate.

15. The slip prevention apparatus of claim 11, wherein the stop element comprises an orb.

16. The slip prevention apparatus of claim 11, wherein the stop element comprises a polyhedron.

17. The slip prevention apparatus of claim 11, wherein the release feature is a buckle.

18. The slip prevention apparatus of claim 11, wherein the release feature is a carabiner.

* * * * *